United States Patent [19]

Aikawa et al.

[11] 4,135,877

[45] Jan. 23, 1979

[54] PROCESS FOR IMPROVING ANTISTATIC AND HYGROSCOPIC PROPERTIES OF FIBERS OR FIBROUS STRUCTURES MADE THEREOF

[75] Inventors: Akira Aikawa, Nagahama; Masao Oguchi, Suita; Toshihide Takeda, Nagahama; Akio Kisaichi, Nagahama; Toshio Saito, Nagahama, all of Japan

[73] Assignee: Kanebo, Ltd., Tokyo, Japan

[21] Appl. No.: 847,037

[22] Filed: Oct. 31, 1977

[30] Foreign Application Priority Data

Jun. 6, 1977 [JP] Japan ..... 52-67172

[51] Int. Cl.[2] ..... D06M 15/36

[52] U.S. Cl. ..... 8/115.5; 8/115.6; 8/128 A; 8/128 R; 8/181; 8/190; 8/194; 8/DIG. 18

[58] Field of Search ..... 8/115.5, 128 R, 128 A, 8/DIG. 18, 190, 194

[56] References Cited

U.S. PATENT DOCUMENTS

| | | | |
|---|---|---|---|
| 3,083,118 | 3/1963 | Bridgeford | 8/DIG. 18 |
| 3,092,512 | 6/1963 | Magat et al. | 8/DIG. 18 |
| 3,313,591 | 4/1967 | Tanner | 8/115.5 |
| 3,598,514 | 8/1971 | Sello et al. | 8/115.6 A |
| 3,687,878 | 8/1972 | Imoto et al. | 8/116 |
| 3,909,195 | 9/1975 | Machell et al. | 8/115.7 |

OTHER PUBLICATIONS

Mark, H. et al., "Chemical after Treatment of Textiles," (Wiley-Interscience, 1971), pp. 490–493.

Sumrell, G., et al., Textile Research J.,-1969, 39, pp. 78–85.

Jones, D. M., et al., J. Soc. Dyers and Colourists, Mar. 1965, pp. 108–114.

*Primary Examiner*—A. Lionel Clingman

*Attorney, Agent, or Firm*—Blanchard, Flynn, Thiel, Boutell & Tanis

[57] ABSTRACT

A novel process for imparting durable antistatic and hygroscopic properties together with an excellent hand to fibers comprised of a high polymer having active hydrogen atoms in its molecule or fibrous structures made thereof is provided. The process is performed by heat treating such fibers or fibrous structures in the presence of a treating solution comprising at least one water-soluble vinyl monomer, acid and water. When the fibers impregnated with the solution are heated, the water-soluble vinyl monomers are graft polymerized with the fibers. The fibers are considered to act as a polymerization initiator, so that the graft polymerization reaction according to the present invention, different from conventional processes, can be effected without the aid of any polymerization initiators such as persulfates or peroxides.

14 Claims, No Drawings

PROCESS FOR IMPROVING ANTISTATIC AND HYGROSCOPIC PROPERTIES OF FIBERS OR FIBROUS STRUCTURES MADE THEREOF

The present invention relates to a novel treating process for imparting excellent durable antistatic and water absorption (or sweat-absorption) properties to fibers or fibrous structures and improving their hand.

A process for imparting antistatic and waterabsorption properties to fibers by means of a treatment in an aqueous solution containing water-soluble monomers such as acrylic acid, acrylamide, N,N'-methylene-bis-acrylamide, together with a polymerization initiator such as persulfates and the like is well known. However, according to such a conventional process, not only does the polymerization require a long period of time but also it is difficult to control the operation conditions, e.g., the reaction temperature, its raising rate and so forth in a practical operation. Furthermore, before monomers in the aqueous solution are graft polymerized with the fibers, they tend to selfpolymerize in the solution to form adhesive homopolymers on the inner wall of the equipment, which causes a time- and labor-consuming cleaning job. Besides, disposal of the residual solution containing a large amount of homopolymer is most likely to become a source of industrial pollution. In another aspect, although the thus treated fibrous structures having their surfaces coated with a thick homopolymer show fairly excellent sweat-absorption or antistatic properties which withstand repeated washing of no more than about 10 times, these properties deteriorate appreciably as the frequency of washing increases up to more than about 20 times, due to stripping off of homopolymers from fibers.

In an alternative polymerization process that comprises impregnating fibers with a solution containing a monomer and a polymerization initiator such as peroxides and persulfates and heating them, it takes a long period of time to start and advance the polymerization reaction; moreover, the polymers adhered to fibers are removed quite easily by washing so that the antistatic and sweat-absorption properties can no longer be retained. Furthermore, in such a process, use of the solution containing persulfates or peroxides as a polymerization initiator not only adds to the production cost, but also requires a careful selection of materials for the treating equipment and the use of nitrogen gas to purge air in the polymerization process.

Still another process which involves applying a water-soluble vinyl monomer together with a polymerization initiator to fibrous structures and heating them in a nonsolvent of the monomer, such as hydrocarbons or the like, has problems of industrial hygiene and workability including solvent recovery. Besides, the process, because it sacrifices the efficiency of the reaction for a suppression of homopolymer formation, is by no means suitable for a commercial process.

Under these circumstances, the inventors have made extensive researches to eliminate many drawbacks in those prior arts and finally accomplished the present invention.

An object of the present invention is to provide fibers or fibrous structures having an excellent durable antistatic and sweat-absorption which well withstand repeated washing.

Another object of the present invention is to provide a novel process of graft polymerization wherein a water-soluble vinyl monomer is graft polymerized with fibrous structures without using any conventional polymerization initiator.

Further objects will be made apparent from the following descriptions.

The above objects of the present invention can be attained by a process for treating fibers or fibrous structures which is characterized by heat treating fibers comprised of a high polymer having active hydrogen atoms in its molecule or fibrous structures made thereof in the presence of a treating solution comprising at least one water-soluble vinyl monomer, acid and water.

As fibers comprised of a high polymer having active hydrogen atoms in its molecule, nitrogen containing fibers, e.g., polyamide fibers such as comprised of polycapramide, polyhexamethyleneadipamide and the like, silk and wool are included. Polyamide fibers, because they have a readiness to undergo of graft polymerization by which their antistatic, sweat-absorption and hand can be remarkably improved, are the most preferable.

By the term "fibrous structures" employed herein is meant threads, batt, staples, woven or knitted fabrics and non-woven fabrics composed of at least one kind of the fibers mentioned above and further fibrous articles dyed, yarn-dyed, scoured, bleached and piece dyed as well as secondary products such as underwears, sweaters, jumpers and the like.

As will be explained in more detail hereinafter, the fact that the fibers or fibrous structures to be treated play a role as an initiator for vinyl monomers in a graft polymerization reaction is one of the features of the present invention. As preferable water-soluble vinyl monomers to be employed in the present invention, mention may be made of N,N'-methylene-bis-acrylamide, tri-acryloyl hexahydrotriazine, methoxy-polyethyleneglycol methacrylate ($CH_2{=}C(CH_3)COO(CH_2CH_2O)_nCH_3O$, wherein n is an integer of 8 to 14 inclusive), polyethyleneglycol monomethacrylate ($CH_2{=}C(CH_3)COO(CH_2CH_20)_nH$, wherein n is an integer of 8 to 14 inclusive), and polyethyleneglycol dimethacrylate ($CH_2{=}C(CH_3)COO(CH_2CH_2O)_nOOC(CH_3)C{=}CH_2$, wherein n is an integer of 8 to 14 inclusive). Among the above, N,N'-methylene-bis-acrylamide is most preferred. Those water-soluble polymerizable monomers can be applied solely or in combination. The amount of these monomers to be applied is in the range of 0.02 to 10% by weight, preferably 0.03 to 5% by weight, and most preferably 0.05 to 2% by weight based on the weight of the treating solution. If the amount is less than 0.02% by weight, the graft-polymerization can hardly proceed, while in case of more than 10% by weight, homopolymers tend to be formed, and the hand of the products is liable to become worse due to their adhering to the fibers.

As the acid to be incorporated into the treating solution, mention may be made of phosphoric, sulfuric, hydrochloric, nitric, acetic, formic, oxalic, tartaric, monochloroacetic, dichloroacetic, trichloroacetic acids and the like. In the case of a dipping process where the fibrous structures are treated in the solution, formic, monochloroacetic, dichloroacetic, trichloroacetic, sulfuric and hydrochloric acids are preferred, while in a pad steam process, formic, acetic, monochloroacetic, sulfuric and hydrochloric acids are preferred. Formic acid, owing to its less corrosiveness to metal and its capacity of facilitating a polymerization reaction, is the most preferable among the acids enumerated above. A suitable amount of the acids in the treating solution is 0.05 to 3% by weight and preferably 0.1 to 1.0% by weight based on the weight of the solution. When the amount of the acid is below 0.05% by weight, the graft polymerization will not effectively proceed. On the other hand, when it exceeds 3% by weight, the hand of the fibrous structures is apt to be harsh due to adhering of homopolymers. The amount of water in the treating solution, therefore, is 87 to 99.93% by weight, preferably 92 to 99.87% by weight based on the weight of the solution.

In order to make the solution permeate sufficiently into fibrous structures, an anionic or nonionic surfactant may be added to the solution. Since the solution used in the process of the present invention is extremely stable so long as it is not in contact with the fibers, a polymerization reaction will not occur in heating, boiling, or even in storing for a long time. On the other hand, in conventional processes in which a catalyst such as persulfates and the like is incorporated into the solution, the solution is so unstable that the polymerization reaction is spontaneously brought about in the absence of the fibers.

In the process according to the present invention, fibrous structures may be soaked in the treating solution and heated therein at a required temperature, or may be impregnated with the solution by padding or spraying and then steamed. Thus, the water-soluble vinyl polymerizable monomer being activated by hydrogen atoms of the fibers rapidly graft polymerizes upon heating with the fibers selectively at the hydrogen atoms thereof. Because of the fact that the residual vinyl monomer remaining in the solution after the graft polymerization reaction has been completed is so stable that homopolymers are not formed in the solution, its reuse is possible, e.g., in the case of the initial concentration being 0.1 to 0.2% by weight, 5 to 10 times successive reuse can be expected, which is also one of the outstanding features of the present invention.

A bath ratio (the ratio of the amount by weight of fibrous structures to be treated to that of the treating solution) in the soaking process of the present invention, although it must naturally be varied according to other conditions employed, may be 1/15 or less, preferably in the range of 1/20 and 1/200. When the amount of the solution is less than 15 times that of the fibrous structures, graft polymerization is hardly effected so that the objects of the present invention cannot be attained. The bath ratio does not necessarily have an upper-limit; however, when the amount of the solution exceeds, for instance, 400 times that of the fibrous structures, the use of a huge tank will come to be inevitable.

The pick-up, when the impregnating process is employed, is 50 to 200% by weight, preferably 70 to 150% by weight, based on the weight of the fibrous structure. If the pick-up is less than 50% by weight, graft polymerization can not almost be carried out, so that an unsatisfactory result will be obtained.

The temperature at which fibrous structures are treated is preferably between 95 and 130° C. in both cases of dipping and impregnating. When the temperature is lower than 95° C., the graft polymerization reaction will not effectively proceed. On the other hand, should it be higher than 130° C., the fibers may be degraded or their hand will get worse.

A desirable period of time for treating the fibrous structure is between 40 minutes and 5 hours, preferably between 1 to 3 hours. When the time is shorter than 40 minutes, a satisfactory result can not be obtained, and when it longer than 5 hours, there will be a fear of degradation of the hand of the fibers.

Since graft polymerization in the process of the present invention can progress in the presence of water as a vehicle, the reaction can be accomplished and the result will be made to be the most sufficient when the dipping process is employed. Therefore, in heating fibrous structures after application of the solution thereto by padding or spraying, wet-heating such as steaming by saturated or wet steam is more recommendable than dry-heating which evaporates water, a vehicle of the reaction.

In the long run, the present invention can provide an improved process in which fibers composed of a polymer having active hydrogen atoms in its molecule or fibrous structures thereof acting as a polymerization initiator are effectively graft polymerized with at least one water-soluble vinyl monomer, selectively at the said hydrogen atoms, without the aid of any conventional radical polymerization catalyst such as persulfates, and without forming homopolymers in the treating solution comprising the above-mentioned monomers, acid and water. Accordingly, the residual treating solution can be reused repeatedly. Thus, the treated fibers or fibrous structures can be provided with excellent durable sweat-absorption and antistatic properties as well as desirable hand. The industrial significance and contribution of the present invention, therefore, is great.

The present invention will be understood more clearly with reference to the following examples; however, these examples are to illustrate the invention and are not to be construed to limit the scope of the invention.

All percentages throughout the examples are by weight unless otherwise clearly designated. Measurements of electrification voltage, insulating resistance, hygroscopicity, add-on percentage of polymer and pleat-settability were conducted as follows. Conditions in washing test are outlined together. Electrification voltage and insulating resistance are made to be indices representing the antistatic property. Hygroscopicity herein defined may indicate a degree of sweat-absorption. Add-on percentage of polymer and results of washing test may give a criterion of effectiveness of graft polymerization.

(1) Electrification voltage:

Test pieces of 5 × 7 cm cut from the treated fabric were allowed to stand at 20° C. under 50% R.H. for 24 hours and the electrification voltage of the test pieces were measured by a rotary static tester (of Kyodai Kaken type and manufactured by Koa Shokai), using cotton calico No. 3 as rubbing cloth under a load of 500 grams and at revolutions of 760 r.p.m. Average of the four values obtained was taken as the electrification voltage.

(2) Insulating resistance:

Five test pieces in round shape (diameter of 5 cm) ere cut from a sampled fabric and allowed to stand at 20° C. under 50% R.H. Insulating resistance of the test pieces was measured with an electrometer (manufactured by Takeda Riken Co., Ltd.). Average of the five values obtained was taken as the insulating resistance.

(3) Hygroscopicity:

A drop of water was applied from 5 cm above onto the test piece through a burette and the time required for reflections of water on the surface of the fabric to vanish was measured. The shorter is the measured time, the better is the hygroscopicity. When the time is zero, therefore, means an instantaneous vanishing of water reflections.

(4) Add-on percentage of polymer:

The weights of absolutely dried specimens before and after the treatment were determined and denoted respectively as B and A. An add-on percentage of polymer is calculated according to the following equation.

$$\text{Add-on percentage of polymer}(\%) = (A - B)/B) \times 100$$

(5) Pleat-settability:

Procedures for determining pleat-settability were carried out in accordance with Japanese Industrial Standard (JIS), L-1018 (B), namely, an opening angle in degree of a pleat ($\alpha$) was measured and the pleat-settability was calculated according to the under described equation. When a smaller value is obtained from the equation, pleatsettability is deemed to be better.

$$\text{Pleat-settability}(\%) = \alpha/180 \times 100$$

(6) Washing test:

Washing machine of Toshiba VH-800 having a revolution of 435 r.p.m. was used. Two grams per liter of water of heavy duty detergent under the trade name of "New Wonderful", a product of Kao Soap Co., Ltd., were used. The specimens were washed at 40° C. for 15 minutes with a bath ratio of 1 : 50 and rinsed for 5 minutes with water. The above treatment was referred to as one washing and the same operation was repeated.

EXAMPLE 1

A process according to the present invention (using no catalysts)

A scoured and heat-set nylon tricot fabric knitted with nylon continuous multi-filament yarn of 30 deniers per 9 filaments, having a weight of 167 grams per square meter and a width of 188 cm was soaked in an aqueous solution of 0.1% of N,N'-methylene-bis-acrylamide and 0.5% of formic acid, with a bath ratio of 1 : 20, which was heated therein at 100° C. for 1 hour. The fabric thus treated was then washed successively with warm water at 50° C. for 20 minutes and with cold water at 20° C. for 20 minutes and finally dried. After the above treatment, the residual treating solution looked colorless and transparent, which proved the fact that substantially no homopolymers had been formed in the solution during the heat treatment.

COMPARATIVE EXAMPLE 1

A conventional process (using a catalyst)

For the purpose of comparison, the same fabric as aforementioned was soaked in a treating solution comprising 0.5% of N,N'-methylene-bis-acrylamide, 0.5% of ammonium ceric nitrate as a polymerization catalyst, 0.5% of formic acid and 98.5% of water, with a bath ratio of 1 : 20. While stirring occasionally, under nitrogen gas stream, the solution was heated in such a manner that the temperature of the solution was raised from room temperature to 70° C. in 20 minutes and thereafter kept at 70° C. for 30 minutes. Thus heat treated fabric was subjected to washing followed by drying in the same manner as described above. It was observed that the residual solution after the treatment had turned to white and turbid and that a considerably large amount of homopolymers was still kept adhered on the fabric even after the washing processes.

COMPARATIVE EXAMPLE 2

A conventional process (using no acids)

The same process as described in Example 1 was carried out, except that the aqueous solution did not contain formic acid. The residual treating solution after the heat treatment was colorless and transparent, wherein any formation of homopolymers was not observed. About the respective fabrics thus treated in Example 1, Comparative Example 1 and Comparative Example 2, electrification voltage, insulating resistance, hygroscopicity and add-on percentage of polymer were determined. Hand of fabric was evaluated both before and after the washing.

It is apparent from the results given in Table 1 that (1) according to the present invention, N,N'-methylene-bis-acrylamide can react with active hydrogen atoms of fibers, forming graft polymers which are bonded to the fibers, providing excellent antistatic property, hygroscopicity and desirable hand to the nylon fabric, which withstand repeated washing, (2) by the process using a catalyst, a polymerization reaction proceeds in the treating solution, so that the amount of graft polymers to be coupled to the fibers decreases wherefor desirable effects are not obtainable, which may be also proved by decreases of electrification voltage, insulating resistance, hygroscopicity and add-on percentage of polymer after repeated washing, and (3) a polymerization reaction can not substantially proceed in the process using no acid and any effect, therefore, can not be recognized. Comparing these results with each other, it is clearly understood that superiorities and advantages of the present invention can be attributed to the function and effect of acids.

Table 1

| Frequency of washing (Times) | | Nil | 10 | 50 |
|---|---|---|---|---|
| Add-on percentage of polymer to fabric (%) | Untreated | — | — | — |
| | Example 1 | 0.29 | 0.26 | 0.26 |
| | Comparative Example 0.30 | 0.14 | 0.05 | |
| | Comparative Example 2 | 0.001 | 0.00 | 0.00 |
| Electrification voltage of fabric (Volt) | Untreated | 6,500 | 8,000 | 8,100 |
| | Example 1 | 950 | 1,100 | 1,200 |
| | Comparative Example 1 | 1,200 | 1,900 | 4,700 |
| | Comparative Example 2 | 6,800 | 8,000 | 8,300 |
| | Untreated | $2.4 \times 10^{12}$ | $3.8 \times 10^{12}$ | $3.8 \times 10^{12}$ |
| | Example 1 | $1.3 \times 10^{8}$ | $3.9 \times 10^{8}$ | $5.3 \times 10^{8}$ |

Table 1-continued

| Frequency of washing (Times) | | Nil | 10 | 50 |
|---|---|---|---|---|
| Insulating resistance (Ω) | Comparative Example 1 | $1.9 \times 10^8$ | $7.5 \times 10^8$ | $9.7 \times 10^{11}$ |
| | Comparative Example 2 | $2.3 \times 10^{12}$ | $7.3 \times 10^{12}$ | $9.5 \times 10^{12}$ |
| | Untreated | 207 | 256 | 257 |
| | Example 1 | 0 | 0 | 1 |
| Hygroscopicity (sec.) | Comparative Example 1 | 0 | 2 | 90 |
| | Comparative Example 2 | 138 | 263 | 265 |
| | Untreated | 1 | 1 | 1 |
| | Example 1 | 4 | 4 | 4 |
| Hand of fabric* | Comparative Example 1 | 4 | 2 | 2 - 1 |
| | Comparative Example 2 | 1 | 1 | 1 |

*Hand was evaluated by feeling using a panel of 10 judges on a scale of 1 to 4. The result obtained was an average of evaluation by the 10 judges.
1 Poor
2 Fairly Good
3 Good
4 Excellent

EXAMPLE 2

After the temperature of the treating solution which was used once in Example 1 was lowered to 80° C., the same nylon tricot fabric as employed in Example 1 was dipped and heated therein at 100° C. for 1 hour with a bath ratio of 1 : 20. Then the treated fabric was washed for 20 minutes each in warm (50° C.) and cold (an ambient temperature) water and dried. The treating solution was repeatedly used as many as five times to treat the fabric. A graft polymerization reaction took place quite effectively every time and formation of homopolymers did not occur. Excellent properties of the fabrics are shown in Table 2.

Table 2

| Time of reuse of treating solution | Hygroscopicity (sec.) | Electrification voltage (Volt) | Add-on percentage of polymer to fabric (%) | Hand of fabric |
|---|---|---|---|---|
| 1st | 1 | 1,200 | 0.25 | 4 |
| 2nd | 1 | 1,200 | 0.26 | 4 |
| 3rd | 2 | 1,300 | 0.24 | 4 |
| 4th | 3 | 1,350 | 0.22 | 4 |
| 5th | 3 | 1,350 | 0.23 | 4 |

N.B. — These results were all obtained after 50 times washing operations.

EXAMPLE 3

Two treating solutions having the same composition as described in Example 1 above, one of which had been newly prepared and the other had been used once to treat fabrics, were preserved individually at 20° C. for 7 days. The same nylon tricot fabrics as employed in Example 1 were treated with those solutions respectively. A homopolymer formation was not observed in both solutions. The results of the treatment are shown in Table 3, by which the followings are clarified.

(1) Whether having been used or not, the treating solution to be applied in the process of the present invention is stable and capable enough for imparting excellent properties to nylon fabrics even after a long time storage.

(2) The polymerization reaction in the process of the present invention can proceed only under existence of nylon which functions as an initiator of the polymerization.

Table 3

| Treating solution | Electrification voltage (Volt) | Insulating resistance (Ω) | Hygroscopicity (sec.) | Add-on percentage of polymer to fabric (%) | Hand of fabric |
|---|---|---|---|---|---|
| Newly prepared | 1,200 | $5.4 \times 10^8$ | 1 | 0.25 | 4 |
| Once used | 1,250 | $5.5 \times 10^8$ | 1 | 0.24 | 4 |

EXAMPLE 4

A process according to the present invention

A nylon tricot fabric scoured and heat-set was soaked and heated at 110° C. for 1 hour in an aqueous solution of 0.05% of N,N'-methylene-bis-acrylamide and 0.5% of formic acid, with a bath ratio of 1 : 50. After the treatment, the fabric was subjected to successive washing at 50° C. for 20 minutes and at an ambient temperature for 20 minutes, followed by drying. The residual solution was as clear as water even after the reaction, so that a homopolymer formation was not recognized.

COMPARATIVE EXAMPLE 3

For the purpose of comparison, the same fabric as used in Example 4 above was soaked and heated at 70° C. for 1 hour in an aqueous solution of 0.3% of N,N'-methylene-bisacrylamide, 0.1% of ammonium persulfate and 0.5% of sulfuric acid, with a bath ratio of 1 : 50. The heating was conducted in such a manner that the temperature of the treating solution was elevated from room temperature up to 70° C. in 30 minutes. After the treatment, the fabric was subjected to warm water washing at 50° C. for 20 minutes and cold water washing at an ambient temperature for 20 minutes, followed by drying. It was observed that the solution after treatment had turned to white and turbid and that a large amount of homopolymers was still kept adhered on the fabric even after the washing process. Insulating resistance, add-on percentage of polymer and hand of the fabric, after 10 and 50 times washing respectively are shown in Table 4. It may be well understood from Table 4 that by applying ammonium persulfate as a catalyst, most monomers in the solution self-polymerize and little amount of graft polymers is formed on the fabric.

COMPARATIVE EXAMPLE 4

Further for the purpose of comparison, the same fabric as employed in Example 4 was treated in the same manner as Example 4, except that formic acid was not used. It is elucidated from the result that a polymerization reaction does not substantially proceed and any expected effect of the treatment cannot be obtained. The result is also given in Table 4.

Table 4

| Frequency of washing (Times) | | Nil | 10 | 50 |
|---|---|---|---|---|
| Add-on percentage of polymer to fabric (%) | Untreated | — | — | — |
| | Example 4 | 0.25 | 0.23 | 0.24 |
| | Comparative Example 3 | 0.32 | 0.08 | 0.03 |
| | Comparative Example 4 | 0.00 | 0.00 | 0.00 |
| Insulating resistance (Ω) | Untreated | $2.4 \times 10^{12}$ | $7.0 \times 10^{12}$ | $8.1 \times 10^{12}$ |
| | Example 4 | $1.1 \times 10^{8}$ | $3.6 \times 10^{8}$ | $3.6 \times 10^{8}$ |
| | Comparative Example 3 | $1.7 \times 10^{8}$ | $7.2 \times 10^{10}$ | $9.3 \times 10^{11}$ |
| | Comparative Example 4 | $2.4 \times 10^{12}$ | $7.1 \times 10^{12}$ | $8.5 \times 10^{12}$ |
| Hand of fabric | Untreated | 1 | 1 | 1 |
| | Example 4 | 4 | 4 | 4 |
| | Comparative Example 3 | 4 | 2 | 2 - 1 |
| | Comparative Example 4 | 1 | 1 | 1 |

EXAMPLE 5

A process according to the present invention

A nylon taffeta composed of nylon continuous multifilament yarn of 70 deniers per 36 filaments, having a weight of 70 grams per square meter and a width of 112 cm, which had been desized, scoured and heat-set was soaked in an aqueous solution of 1.0% of N,N'-methylene-bis-acrylamide and 0.15% of acetic acid, squeezed by nipped rolls to a pick-up of 100% and steamed at 100° C. for 1 hour. The treated fabric was washed with water successively at 60° C. for 20 minutes and at an ambient temperature for 20 minutes. In the waste water from the washer, homopolymers were not contained at all, which proved the fact that the graft polymerization reaction had been effectively accomplished and no homopolymers had been formed on the fabric.

COMPARATIVE EXAMPLE 5

The same fabric as used in Example 5 was soaked in an aqueous solution of 1.0% of N,N'-methylene-bis-acrylamide, 0.2% of potassium persulfate (catalyst), 0.5% of sulfuric acid, squeezed by nipped rolls to a pick-up of 100% and steamed at 100° C. for 1 hour. Washing of the fabrics was successively conducted with water at 60° C. for 20 minutes, and at an ambient temperature for 20 minutes. In the waste water from the washer, a considerably large amount of homopolymers stripped off from the fiber was observed.

COMPARATIVE EXAMPLE 6

The same fabric as used in Example 5 was treated in the same manner as described in Example 5, except that acetic acid was not added to the aqueous solution. As the result, neither the polymerization reaction did proceed nor any desirable effect of the treatment was obtained.

Table 5 shows hygroscopicity, hand and pleat-settability of fabrics untreated and treated in Example 5 and Comparative Examples 5 and 6 above, respectively before and after washing.

Table 5

| Frequency of washing (Times) | | Nil | 10 | 50 |
|---|---|---|---|---|
| Hygroscopicity (sec.) | Untreated | 311 | 345 | 350 |
| | Example 5 | 3 | 7 | 8 |
| | Comparative Example 5 | 4 | 25 | 81 |
| | Comparative Example 6 | 310 | 340 | 340 |
| Hand of fabric | Untreated | 1 | 1 | 1 |
| | Example 5 | 4 | 4 | 4 |
| | Comparative Example 5 | 4 | 2 | 2 - 1 |
| | Comparative Example 6 | 1 | 1 | 1 |
| Pleat-settability (%) Upper fig.: warp Lower fig.: fill | Untreated | 55 | 56 | 57 |
| | (Times) | 52 | 55 | 58 |
| | Example 5 | 48 | 49 | 50 |
| | | 38 | 40 | 41 |
| | Comparative | 48 | 52 | 53 |
| | Example 5 | 39 | 48 | 50 |
| | Comparative | 55 | 55 | 58 |
| | Example 6 | 54 | 56 | 57 |
| Add-on percentage of polymer to fabric (%) | Untreated | — | — | — |
| | Example 5 | 0.28 | 0.27 | 0.25 |
| | Comparative Example 5 | 0.25 | 0.05 | 0.03 |
| | Comparative Example 6 | 0.03 | 0.00 | 0.00 |
| Electrification voltage of fabric (Volt) | Untreated | 9,000 | 9,100 | 9,400 |
| | Example 5 | 2,100 | 2,200 | 2,400 |
| | Comparative Example 5 | 4,700 | 7,300 | 7,600 |

Table 5-continued

| Frequency of washing (Times) | | Nil | 10 | 50 |
|---|---|---|---|---|
| | Comparative Example 6 | 8,800 | 9,000 | 9,300 |

EXAMPLE 6

The same treatments as described in Example 1 of a process of the present invention (using no catalyst) and Comparative Example 2 of a conventional process (using no acid) were carried out, except that 0.2% of triacryloyl hexahydrotriazine (hereinafter referred to as "Monomer 1"), 0.3% of methoxy-polyethyleneglycol methacrylate (an average mole number of ethyleneoxide added: 9) (hereinafter referred to as "Monomer 2"), 0.5% of polyethyleneglycol mono-methacrylate (an average mole number of ethyleneoxide added: 8) (hereinafter referred to as "Monomer 3") and 0.4% of polyethyleneglycol di-methacrylate (an average mole number of ethyleneoxide added: 14) (hereinafter referred to as "Monomer 4") were used, in lieu of 0.1% of N,N'-methylene-bis-acrylamide. Electrification voltage, insulating resistance, hygroscopicity, hand of fabric and add-on percentage of polymer were determined on the treated fabrics both before and after washing and shown in Table 6.

EXAMPLE 7

The same treatments as described in Example 1 of a process of the present invention (using no catalyst) and in Comparative Example 2 of a conventional process (using no acid) were carried out, except that a silk flat crepe of 92 cm wide, woven with a warp yarn of 3 filaments of 21 deniers and filling yarns of 3 filaments of 21 deniers having twists of 3,100 turns per meter in S and Z directions was used instead of the nylon tricot fabric.

Table 7 shows add-on percentage of polymer, insulating resistance, electrification voltage and hygroscopicity of the fabrics both treated and untreated, respectively before and after washing. It is apparent from Table 7 that (1) according to the present invention, graft polymerization takes place effectively, so that desirable properties can be imparted to silk and polymers adhered to the silk would not be stripped off by repeated washing, and (2) unless an acid is incorporated into the solution, any desirable properties cannot be provided, since the graft polymerization does not substantially proceed.

Table 6

| Monomer | Frequency of washing (Times) | Add-on percentage of polymer to fabric (%) | | Electrification voltage of fabric (Volt) | | Insulating resistance (Ω) | | Hygroscopicity (sec.) | | Hand of fabric | |
|---|---|---|---|---|---|---|---|---|---|---|---|
| | | Treated as Example 1 | Treated as Comparative Example 2 | Treated as Example 1 | Treated as Comparative Example 2 | Treated as Example 1 | Treated as Comparative Example 2 | Treated as Example 1 | Treated as Comparative Example 2 | Treated as Example 1 | Treated as Comparative Example 2 |
| | Nil | 0.29 | 0.03 | 900 | 6,800 | $1.3 \times 10^8$ | $2.6 \times 10^{12}$ | 0 | 142 | 4 | 1 |
| 1 | 10 | 0.27 | 0.01 | 1,250 | 7,800 | $3.6 \times 10^8$ | $7.3 \times 10^{12}$ | 0 | 317 | 4 | 1 |
| | 50 | 0.27 | 0.00 | 1,350 | 8,100 | $3.8 \times 10^8$ | $8.7 \times 10^{12}$ | 1 | 318 | 4 | 1 |
| | Nil | 0.93 | 0.01 | 850 | 7,200 | $1.9 \times 10^8$ | $4.5 \times 10^{12}$ | 0 | 170 | 4 | 1 |
| 2 | 10 | 0.71 | 0.00 | 2,200 | 8,700 | $3.0 \times 10^9$ | $8.8 \times 10^{12}$ | 1 | 315 | 4 | 1 |
| | 50 | 0.68 | 0.00 | 3,400 | 9,000 | $9.9 \times 10^9$ | $8.7 \times 10^{12}$ | 2 | 326 | 4 | 1 |
| | Nil | 0.85 | 0.01 | 950 | 7,300 | $2.4 \times 10^8$ | $5.2 \times 10^{12}$ | 0 | 263 | 3 | 1 |
| 3 | 10 | 0.64 | 0.00 | 2,500 | 8,900 | $3.1 \times 10^9$ | $8.7 \times 10^{12}$ | 1 | 327 | 3 | 1 |
| | 50 | 0.61 | 0.00 | 3,600 | 9,100 | $9.8 \times 10^9$ | $9.0 \times 10^{12}$ | 2 | 358 | 3 | 1 |
| | Nil | 0.74 | 0.01 | 900 | 7,000 | $2.9 \times 10^8$ | $4.2 \times 10^{12}$ | 0 | 236 | 3 | 1 |
| 4 | 10 | 0.61 | 0.00 | 1,700 | 8,800 | $2.7 \times 10^9$ | $8.0 \times 10^{12}$ | 1 | 314 | 3 | 1 |
| | 50 | 0.57 | 0.00 | 2,400 | 9,100 | $3.1 \times 10^9$ | $8.6 \times 10^{12}$ | 1 | 328 | 3 | 1 |

Table 7

| Frequency of washing (Times) | | Nil | 10 | 50 |
|---|---|---|---|---|
| Add-on percentage of polymer to fabric (%) | Untreated | — | — | — |
| | Treated as Example 1 | 0.52 | 0.48 | 0.47 |
| | Treated as Comparative Example 2 | 0.03 | 0.01 | 0.01 |
| Insulating resistance (Ω) | Untreated | $6.2 \times 10^9$ | $1.3 \times 10^{10}$ | $9.7 \times 10^9$ |
| | Treated as Example 1 | $9.4 \times 10^7$ | $1.2 \times 10^8$ | $1.6 \times 10^8$ |
| | Treated as Comparative Example 2 | $5.1 \times 10^9$ | $7.8 \times 10^9$ | $8.3 \times 10^9$ |
| Electrification voltage of fabric (Volt) | Untreated | 2,800 | 3,100 | 3,200 |
| | Treated as Example 1 | 700 | 900 | 900 |
| | Treated as Comparative Example 2 | 2,700 | 3,000 | 3,200 |
| Hygroscopicity (sec.) | Untreated | 15 | 17 | 17 |
| | Treated as Example 1 | 0 | 0 | 0 |
| | Treated as Comparative Example 2 | 14 | 17 | 16 |

EXAMPLE 8

The same treatment as described in Example 1 was effected, except that the treating solutions listed in Table 8 were prepared and used.

Table 8

| Treating solution No. | N,N'-methylene-bis-acrylamide (%) | Formic acid (%) | Water (%) |
|---|---|---|---|
| 1 | 0.03 | 0.5 | 99.47 |
| 2 | 5.0 | 0.5 | 94.5 |
| 3 | 0.1 | 0.05 | 99.85 |
| 4 | 0.1 | 3.0 | 96.9 |
| 5 | 0.05 | 1.0 | 98.95 |
| 6 | 1.0 | 0.2 | 98.97 |
| 7 | 2.0 | 0.2 | 97.98 |
| 8 | 5.0 | 0.1 | 94.99 |
| 9 | 0.02 | 3.0 | 96.98 |
| 10 | 10.0 | 0.05 | 89.95 |
| 11 | 13.0 | 0.1 | 84.90 |

Add-on percentage of polymer to fabric, hygroscopicity, insulating resistance and electrification voltage before and after washing are enumerated in Table 9.

Table 9

| Treating solution No. | Frequency of washing (Times) | Add-on percentage of polymer to fabric (%) | Hygroscopicity (sec.) | Insulating resistance (Ω) | Electrification voltage of fabric (Volt) | Hand of fabric |
|---|---|---|---|---|---|---|
| | Nil | 0.28 | 0 | $2.1 \times 10^8$ | 950 | 4 |
| 1 | 10 | 0.25 | 0 | $4.8 \times 10^8$ | 1,400 | 4 |
| | 50 | 0.24 | 1 | $5.3 \times 10^8$ | 1,700 | 4 |
| | Nil | 0.76 | 0 | $1.2 \times 10^6$ | 180 | 4 |
| 2 | 10 | 0.72 | 0 | $5.0 \times 10^6$ | 250 | 4 |
| | 50 | 0.70 | 1 | $7.8 \times 10^6$ | 300 | 4 |
| | Nil | 0.27 | 0 | $2.7 \times 10^8$ | 1,000 | 4 |
| 3 | 10 | 0.26 | 0 | $5.1 \times 10^8$ | 1,600 | 4 |
| | 50 | 0.26 | 1 | $5.6 \times 10^8$ | 2,000 | 4 |
| | Nil | 0.82 | 0 | $5.6 \times 10^6$ | 250 | 4 - 3 |
| 4 | 10 | 0.77 | 0 | $1.2 \times 10^7$ | 300 | 4 - 3 |
| | 50 | 0.74 | 1 | $3.5 \times 10^7$ | 450 | 4 - 3 |
| | Nil | 0.29 | 0 | $2.2 \times 10^8$ | 950 | 4 |
| 5 | 10 | 0.28 | 0 | $4.5 \times 10^8$ | 1,300 | 4 |
| | 50 | 0.28 | 1 | $5.2 \times 10^8$ | 1,650 | 4 |
| | Nil | 0.31 | 0 | $1.2 \times 10^8$ | 850 | 4 |
| 6 | 10 | 0.30 | 0 | $4.5 \times 10^8$ | 1,250 | 4 |
| | 50 | 0.30 | 1 | $4.8 \times 10^8$ | 1,400 | 4 |
| | Nil | 0.33 | 0 | $1.0 \times 10^8$ | 750 | 4 |
| 7 | 10 | 0.31 | 0 | $4.0 \times 10^8$ | 950 | 4 |
| | 50 | 0.31 | 1 | $5.1 \times 10^8$ | 1,000 | 4 |
| | Nil | 0.31 | 0 | $1.5 \times 10^8$ | 800 | 4 |
| 8 | 10 | 0.30 | 0 | $5.2 \times 10^8$ | 1,000 | 4 |
| | 50 | 0.29 | 1 | $6.5 \times 10^8$ | 1,300 | 4 |
| | Nil | 0.21 | 1 | $9.8 \times 10^8$ | 2,300 | 4 - 3 |
| 9 | 10 | 0.19 | 5 | $1.2 \times 10^9$ | 2,400 | 4 - 3 |
| | 50 | 0.18 | 7 | $3.5 \times 10^9$ | 2,500 | 4 - 3 |
| | Nil | 0.59 | 0 | $9.5 \times 10^7$ | 550 | 4 - 3 |
| 10 | 10 | 0.41 | 1 | $2.1 \times 10^8$ | 750 | 4 - 3 |
| | 50 | 0.38 | 1 | $8.1 \times 10^8$ | 1,050 | 4 - 3 |
| | Nil | 2.50 | 0 | $3.5 \times 10^5$ | 100 | 1 |
| 11 | 10 | 0.31 | 1 | $9.5 \times 10^7$ | 300 | 1 |
| | 50 | 0.15 | 15 | $2.1 \times 10^9$ | 3,500 | 1 |

EXAMPLE 9

The same treatment as described in Example 1 was effected, except that monochloroacetic, acetic, tartaric, sulfuric, hydrochloric, nitric, dichloroacetic, trichloroacetic, oxalic and phosphoric acids were respectively used instead of formic acid. Electrification voltage, hygroscopicity, add-on percentage of polymer to fabric and hand of the treated fabrics after 50 times washing operations are given in Table 10.

Table 10

| Acid | Add-on percentage of polymer to fabric (%) | Hygroscopicity (sec.) | Electrification voltage (Volt) | Hand of fabric |
|---|---|---|---|---|
| Formic (Example 1) | 0.26 | 1 | 1,200 | 4 |
| Monochloroacetic | 0.27 | 1 | 1,150 | 4 |
| Acetic | 0.21 | 1 | 1,250 | 3 |
| Sulfuric | 0.27 | 1 | 1,250 | 4 |
| Tartaric | 0.23 | 1 | 1,250 | 3 - 4 |
| Hydrochloric | 0.24 | 1 | 1,250 | 4 |
| Nitric | 0.24 | 1 | 1,250 | 4 |
| Dichloroacetic | 0.27 | 1 | 1,250 | 4 |
| Trichloroacetic | 0.25 | 1 | 1,200 | 4 |
| Oxalic | 0.20 | 1 | 1,300 | 3 |
| Phosphoric | 0.20 | 1 | 1,300 | 3 |

EXAMPLE 10

The same treatments as described in Example 1 of a process of the present invention (using no catalysts) and in Comparative Example 2 of a conventional process (using no acids) were carried out, except that a woolen twill fabric having a weight of 26 grams per square meter, woven with warp and filling yarn of 2 ply/48 count having a first twist of 570 t.p.m./Z and a second twist of 540 t.p.m./S, was used in lieu of the nylon tricot fabric. The results are shown in Table 11.

Table 11

| Frequency of washing (Times) | | Nil | 10 | 50 |
|---|---|---|---|---|
| Add-on percentage of polymer to fabric (%) | Untreated | — | — | — |
| | Treated as Example 1 | 0.50 | 0.44 | 0.43 |
| | Treated as Comparative Example 2 | 0.02 | 0.01 | 0.01 |
| Insulating resistance (Ω) | Untreated | $3.9\times10^{12}$ | $7.8\times10^{12}$ | $8.0\times10^{12}$ |
| | Treated as Example 1 | $3.6\times10^{8}$ | $9.5\times10^{8}$ | $9.8\times10^{8}$ |
| | Treated as Comparative Example 2 | $1.5\times10^{12}$ | $9.5\times10^{12}$ | $7.5\times10^{12}$ |
| Electrification voltage of fabric (Volt) | Untreated | 7,000 | 8,500 | 8,700 |
| | Treated as Example 1 | 1,000 | 1,300 | 1,400 |
| | Treated as Comparative Example 2 | 6,500 | 8,400 | 8,600 |
| Hygroscopicity (sec.) | Untreated | 7,600 | 7,600 | 7,600 |
| | Treated as Example 1 | 0 | 0 | 1 |
| | Treated as Comparative Example 2 | 7,500 | 7,600 | 7,600 |

EXAMPLE 11

The same treatment as described in Example 1 was effected, except that the treating temperature was varied as shown in Table 2. The results are shown in Table 12. An autoclave was used in the case where the treating temperature was either 130° C. or 140° C.

Table 12

| Treating temperature (° C) | Frequency of washing (Times) | Add-on percentage of polymer to fabric (%) | Insulating resistance (Ω) | Electrification voltage of fabric (Volt) | Hygroscopicity (sec.) | Hand of fabric |
|---|---|---|---|---|---|---|
| 90 | Nil | 0.06 | $3.4\times10^{12}$ | 7,800 | 120 | 2 |
| | 50 | 0.03 | $5.4\times10^{12}$ | 7,150 | 310 | 1 |
| 95 | Nil | 0.23 | $2.1\times10^{9}$ | 2,100 | 8 | 4 |
| | 50 | 0.21 | $5.9\times10^{9}$ | 2,300 | 10 | 4 – 3 |
| 100 | Nil | 0.29 | $1.3\times10^{8}$ | 950 | 0 | 4 |
| (Example 1) | 50 | 0.26 | $5.3\times10^{8}$ | 1,200 | 1 | 4 |
| 130 | Nil | 0.29 | $1.4\times10^{8}$ | 950 | 0 | 4 |
| | 50 | 0.27 | $6.5\times10^{8}$ | 1,100 | 1 | 4 |
| 140 | Nil | 0.27 | $2.5\times10^{8}$ | 1,000 | 1 | 1 |
| | 50 | 0.25 | $7.1\times10^{8}$ | 1,150 | 3 | 1 |

EXAMPLE 12

The same treatment as described in Example 5 was effected, except that the temperature of steaming was varied from 90 to 140° C. The results are shown in Table 13.

Table 13

| Temperature of steaming (° C) | Frequency of washing (Times) | Add-on percentage of polymer to fabric (%) | Insulating resistance (Ω) | Electrification voltage of fabric (Volt) | Hygroscopicity (sec.) | Hand of fabric |
|---|---|---|---|---|---|---|
| 90 | Nil | 0.02 | $7.5\times10^{12}$ | 9,100 | 250 | 1 |
| | 50 | 0.01 | $8.1\times10^{12}$ | 9,400 | 290 | 1 |
| 95 | Nil | 0.22 | $9.8\times10^{8}$ | 2,300 | 11 | 4 |
| | 50 | 0.20 | $1.4\times10^{9}$ | 2,500 | 15 | 4 |
| 100 | Nil | 0.28 | $8.6\times10^{8}$ | 2,100 | 3 | 4 |
| (Example 5) | 50 | 0.25 | $9.3\times10^{8}$ | 2,400 | 8 | 4 |
| 130 | Nil | 0.27 | $8.8\times10^{8}$ | 2,150 | 4 | 4 |
| | 50 | 0.25 | $9.5\times10^{8}$ | 2,350 | 8 | 4 |
| 140 | Nil | 0.25 | $9.6\times10^{8}$ | 2,300 | 8 | 1 |
| | 50 | 0.23 | $1.3\times10^{9}$ | 2,400 | 10 | 1 |

EXAMPLE 13

Except that the pick-up ratio was varied, the same treatment as described in Example 5 was effected. The results are given in Table 14.

Table 14

| Pick-up (%) | Frequency of washing (Times) | Add-on percentage of polymer to fabric (%) | Insulating resistance (Ω) | Electrification voltage of fabric (Volt) | Hygroscopicity (sec.) |
|---|---|---|---|---|---|
| 50 | Nil | 0.27 | $1.7\times10^{9}$ | 2,500 | 7 |
| | 50 | 0.25 | $2.3\times10^{9}$ | 2,800 | 13 |
| 70 | Nil | 0.26 | $9.0\times10^{8}$ | 2,100 | 3 |
| | 50 | 0.24 | $1.5\times10^{9}$ | 2,400 | 6 |
| 100 | Nil | 0.28 | $8.6\times10^{8}$ | 2,100 | 3 |
| (Example 5) | 50 | 0.25 | $9.3\times10^{8}$ | 2,400 | 8 |
| 150 | Nil | 0.27 | $9.1\times10^{8}$ | 2,100 | 4 |
| | 50 | 0.25 | $1.1\times10^{9}$ | 2,400 | 6 |
| 200 | Nil | 0.27 | $9.2\times10^{8}$ | 2,100 | 8 |
| | 50 | 0.25 | $1.2\times10^{9}$ | 2,400 | 10 |

EXAMPLE 14

The same treatment as described in Example 1 was effected, except that the bath ratio was varied. The results are shown in Table 15.

Table 15

| Bath ratio | Frequency of washing (Times) | Add-on percentage of polymer to fabric (%) | Insulating resistance (Ω) | Electrification voltage of fabric (Volt) | Hygroscopicity (sec.) | Hand of fabric |
|---|---|---|---|---|---|---|
| 1:400 | Nil | 0.30 | $2.3 \times 10^8$ | 950 | 0 | 4 |
| | 50 | 0.27 | $6.6 \times 10^8$ | 1,100 | 1 | 4 |
| 1:300 | Nil | 0.30 | $2.1 \times 10^8$ | 950 | 0 | 4 |
| | 50 | 0.27 | $5.4 \times 10^8$ | 1,100 | 1 | 4 |
| 1:200 | Nil | 0.30 | $2.7 \times 10^8$ | 1,100 | 0 | 4 |
| | 50 | 0.27 | $5.4 \times 10^8$ | 1,150 | 1 | 4 |
| 1:100 | Nil | 0.29 | $2.2 \times 10^8$ | 950 | 0 | 4 |
| | 50 | 0.26 | $5.3 \times 10^8$ | 1,100 | 1 | 4 |
| 1:50 | Nil | 0.29 | $2.2 \times 10^8$ | 900 | 0 | 4 |
| | 50 | 0.26 | $5.4 \times 10^8$ | 1,150 | 1 | 4 |
| 1:30 | Nil | 0.29 | $2.4 \times 10^8$ | 1,000 | 0 | 4 |
| | 50 | 0.26 | $5.5 \times 10^8$ | 1,250 | 1 | 4 |
| 1:20 | Nil | 0.29 | $1.3 \times 10^8$ | 950 | 0 | 4 |
| Example 1) | 50 | 0.26 | $5.3 \times 10^8$ | 1,200 | 1 | 4 |
| 1:15 | Nil | 0.24 | $5.5 \times 10^8$ | 1,300 | 2 | 4 |
| | 50 | 0.22 | $9.9 \times 10^8$ | 1,450 | 13 | 3 – 2 |
| 1:10 | Nil | 0.05 | $9.8 \times 10^{11}$ | 3,900 | 210 | 2 – 1 |
| | 50 | 0.03 | $4.7 \times 10^{12}$ | 4,800 | 250 | 1 |
| 1:5 | Nil | 0.03 | $4.8 \times 10^{12}$ | 4,800 | 250 | 1 |
| | 50 | 0.01 | $8.5 \times 10^{12}$ | 5,600 | 320 | 1 |

EXAMPLE 15

The same treatment as described in Example 1 was effected, except that the period of time of treatment was varied. The results are shown in Table 16.

Table 16

| Treating time (Hr.) | Frequency of washing (Times) | Add-on percentage of polymer to fabric (%) | Insulating resistance (Ω) | Electrification voltage of fabric (Volt) | Hygroscopicity (sec.) | Hand of fabric |
|---|---|---|---|---|---|---|
| ¼ | Nil | 0.00 | $8.7 \times 10^{12}$ | 8,000 | 260 | 1 |
| | 50 | 0.00 | $9.1 \times 10^{12}$ | 8,100 | 270 | 1 |
| ½ | Nil | 0.01 | $3.5 \times 10^{11}$ | 7,100 | 250 | 1 |
| | 50 | 0.01 | $9.1 \times 10^{11}$ | 7,600 | 300 | 1 |
| ⅝ | Nil | 0.22 | $1.2 \times 10^9$ | 1,350 | 5 | 4 |
| | 50 | 0.20 | $5.1 \times 10^9$ | 1,500 | 7 | 4 |
| ¾ | Nil | 0.25 | $2.9 \times 10^8$ | 900 | 3 | 4 |
| | 50 | 0.23 | $9.5 \times 10^8$ | 1,200 | 5 | 4 |
| 1 (Example 1) | Nil | 0.29 | $1.3 \times 10^8$ | 950 | 0 | 4 |
| | 50 | 0.26 | $5.3 \times 10^8$ | 1,200 | 1 | 4 |
| 2 | Nil | 0.32 | $1.1 \times 10^8$ | 900 | 0 | 4 |
| | 50 | 0.29 | $3.1 \times 10^8$ | 950 | 1 | 4 |
| 3 | Nil | 0.32 | $1.1 \times 10^8$ | 900 | 0 | 4 |
| | 50 | 0.29 | $3.1 \times 10^8$ | 950 | 1 | 4 |
| 4 | Nil | 0.29 | $4.5 \times 10^8$ | 1,000 | 1 | 4 |
| | 50 | 0.27 | $8.4 \times 10^8$ | 1,150 | 2 | 4 |
| 5 | Nil | 0.28 | $5.6 \times 10^8$ | 1,100 | 1 | 3 |
| | 50 | 0.25 | $9.5 \times 10^8$ | 1,250 | 2 | 3 |
| 7 | Nil | 0.27 | $9.5 \times 10^8$ | 1,200 | 1 | 1 |
| | 50 | 0.23 | $1.2 \times 10^9$ | 1,400 | 4 | 1 |

EXAMPLE 16

The same treatments as described in Example 5 of a process of the present invention (using no catalysts) and Comparative Example 6 of a conventional process (using no acid) were effected, except that Monomer 1 hereinbefore defined, methoxy-polyethyleneglycol methacrylate (an average mole number of ethyleneoxide added: 14) (hereinafter referred to as "Monomer 5"), polyethyleneglycol mono-methacrylate (an average mole number of ethylene oxide added: 10) (hereinafter referred to as "Monomer 6") and polyethyleneglycol dimethacrylate (an average mole number of ethylene oxide added: 8) (hereinafter referred to as "Monomer 7") were used respectively in the four processes of one series, in lieu of N,N'-methylene-bis-acrylamide. The results are shown in Table 17.

Table 17

| Monomer | Frequency of washing (Times) | Add-on percentage of polymer to fabric (%) | | Electrification voltage of fabric (Volt) | | Insulating resistance (Ω) | | Hygroscopicity (sec.) | | Hand of fabric | |
|---|---|---|---|---|---|---|---|---|---|---|---|
| | | Treated as Example 5 | Treated as Comparative Example 6 | Treated as Example 5 | Treated as Comparative Example 6 | Treated as Example 5 | Treated as Comparative Example 6 | Treated as Example 5 | Treated as Comparative Example 6 | Treated as Example 5 | Treated as Comparative Example 6 |
| | Nil | 0.27 | 0.02 | 1,000 | 6,850 | $4.5 \times 10^8$ | $2.6 \times 10^{12}$ | 0 | 42 | 4 | 1 |
| 1 | 10 | 0.26 | 0.01 | ,350 | 7,900 | $5.8 \times 10^8$ | $7.5 \times 10^{12}$ | 0 | 320 | 4 | 1 |

Table 17-continued

| Monomer | Frequency of washing (Times) | Add-on percentage of polymer to fabric (%) | | Electrification voltage of fabric (Volt) | | Insulating resistance (Ω) | | Hygroscopicity (sec.) | | Hand of fabric | |
|---|---|---|---|---|---|---|---|---|---|---|---|
| | | Treated as Example 5 | Treated as Comparative Example 6 | Treated as Example 5 | Treated as Comparative Example 6 | Treated as Example 5 | Treated as Comparative Example 6 | Treated as Example 5 | Treated as Comparative Example 6 | Treated as Example 5 | Treated as Comparative Example 6 |
| | 50 | 0.26 | 0.00 | 1,450 | 8,100 | $8.8 \times 10^8$ | $8.7 \times 10^{12}$ | 1 | 318 | 4 | 1 |
| | Nil | 0.81 | 0.01 | 900 | 7,200 | $4.5 \times 10^8$ | $4.6 \times 10^{12}$ | 0 | 175 | 4 | 1 |
| 5 | 10 | 0.61 | 0.00 | 2,300 | 8,700 | $9.5 \times 10^9$ | $8.9 \times 10^{12}$ | 1 | 314 | 4 | 1 |
| | 50 | 0.60 | 0.00 | 3,600 | 9,100 | $9.9 \times 10^9$ | $8.7 \times 10^{12}$ | 2 | 330 | 3 | 1 |
| | Nil | 0.71 | 0.01 | 1,050 | 7,300 | $6.4 \times 10^8$ | $5.3 \times 10^{12}$ | 0 | 265 | 3 | 1 |
| 6 | 10 | 0.50 | 0.00 | 2,100 | 8,950 | $5.1 \times 10^9$ | $8.8 \times 10^{12}$ | 1 | 327 | 3 | 1 |
| | 50 | 0.49 | 0.00 | 3,500 | 9,100 | $8.1 \times 10^9$ | $9.1 \times 10^{12}$ | 2 | 360 | 3 | 1 |
| | Nil | 0.64 | 0.01 | 950 | 7,100 | $4.9 \times 10^8$ | $4.3 \times 10^{12}$ | 0 | 240 | 3 | 1 |
| 7 | 10 | 0.60 | 0.00 | 1,900 | 8,800 | $3.1 \times 10^9$ | $8.0 \times 10^{12}$ | 1 | 313 | 3 | 1 |
| | 50 | 0.49 | 0.00 | 2,600 | 9,150 | $3.7 \times 10^9$ | $8.7 \times 10^{12}$ | 1 | 321 | 3 | 1 |

EXAMPLE 17

The same treatment as described in Example 5 was effected, except that various acids other than acetic acid were used. After the treated fabrics were washed 50 times, their add-on percentage of polymer to fabric, hygroscopicity, insulating voltage and hand were determined. The results are shown in Table 18.

Table 18

| Acid | Add-on percentage of polymer to fabric (%) | Hygroscopicity (sec.) | Electrification voltage of fabric (Volt) | Hand of fabric |
|---|---|---|---|---|
| Formic | 0.26 | 8 | 2,500 | 4 |
| Monochloroacetic | 0.26 | 7 | 2,500 | 4 |
| Acetic (Example 5) | 0.25 | 8 | 2,400 | 4 |
| Sulfuric | 0.25 | 7 | 2,500 | 4 |
| Tartaric | 0.21 | 25 | 3,100 | 3 – 4 |
| Hydrochloric | 0.26 | 8 | 2,500 | 4 |
| Nitric | 0.23 | 13 | 2,450 | 4 |
| Dichloroacetic | 0.26 | 8 | 2,500 | 4 |
| Trichloroacetic | 0.26 | 8 | 2,550 | 4 |
| Oxalic | 0.22 | 25 | 3,200 | 3 |
| Phosphoric | 0.21 | 26 | 3,200 | 3 |

EXAMPLE 18

The same treatments as described in Example 1 of a process of the present invention and Comparative Example 2 of a conventional process were effected, except that a silk flat crepe fabric same as used in Example 7 was used instead of the nylon tricot fabric and that 0.2% of Monomer 1 hereinbefore defined, 0.3% of methoxypolyethyleneglycol methacrylate (an average mole number of ethyleneoxide added: 8) (hereinafter referred to as "Monomer 8"), 0.5% of polyethyleneglycol monomethacrylate (an average mole number of ethyleneoxide added: 14) (hereinafter referred to as "Monomer 9") and 0.4% of Monomer 7 hereinbefore defined were used in lieu of 0.1% of N,N'-methylene-bis-acrylamide. The results are shown in Table 19.

Table 19

| Monomer | Frequency of washing (Times) | Add-on percentage of polymer to fabric (%) | | Electrification voltage of fabric (Volt) | | Hygroscopicity (sec.) | |
|---|---|---|---|---|---|---|---|
| | | Treated as Example 1 | Treated as Comparative Example 2 | Treated as Example 1 | Treated as Comparative Example 2 | Treated as Example 1 | Treated as Comparative Example 2 |
| | Nil | 0.56 | 0.02 | 700 | 2,700 | 0 | 15 |
| 1 | 10 | 0.52 | 0.01 | 900 | 3,100 | 1 | 18 |
| | Nil | 0.82 | 0.02 | 900 | 2,700 | 0 | 16 |
| 8 | 10 | 0.61 | 0.01 | 1,500 | 3,200 | 2 | 18 |
| | Nil | 0.85 | 0.01 | 1,700 | 2,650 | 0 | 15 |
| 9 | 10 | 0.62 | 0.00 | 1,900 | 3,250 | 2 | 18 |
| | Nil | 0.75 | 0.02 | 1,450 | 2,550 | 0 | 15 |
| 7 | 10 | 0.57 | 0.01 | 1,600 | 3,100 | 1 | 18 |

EXAMPLE 19

The same treatments as described in Example 1 of a process of the present invention and Comparative Example 2 of a conventional process were effected, except that the same woolen twill fabric as used in Example 10 was used instead of the nylon tricot fabric and that 0.2% of Monomer 1 hereinbefore defined, 0.3% of methoxypolyethyleneglycol methyacrylate (an average mole number of ethyleneoxide added: 10) (hereinafter referred to as "Monomer 10"), 0.5% of polyethyleneglycol mono-methacrylate (an average mole number of ethyleneoxide added: 15) (hereinafter referred to as "Monomer 11") and 0.4% of polyethyleneglycol dimethacrylate (an average mole number of ethyleneoxide added: 12) (hereinafter referred to as "Monomer 12") were used respectively instead of 0.1% of N,N'-methylene-bis-acrylamide. The results are shown in Table 20.

Table 20

| Monomer | Frequency of washing (Times) | Add-on percentage of polymer to fabric (%) | | Electrification voltage of fabric (Volt) | | Hygroscopicity (sec.) | |
|---|---|---|---|---|---|---|---|
| | | Treated as Example 1 | Treated as Comparative Example 2 | Treated as Example 1 | Treated as Comparative Example 2 | Treated as Example 1 | Treated as Comparative Example 2 |
| | Nil | 0.52 | 0.02 | 1,100 | 6,500 | 0 | 7,500 |
| 1 | 10 | 0.46 | 0.01 | 1,450 | 8,600 | 1 | 7,600 |
| | Nil | 0.78 | 0.02 | 1,750 | 6,550 | 0 | 7,550 |
| 10 | 10 | 0.60 | 0.00 | 1,900 | 8,650 | 2 | 7,650 |
| | Nil | 0.84 | 0.01 | 1,800 | 6,750 | 0 | 7,600 |
| 11 | 10 | 0.60 | 0.00 | 2,000 | 8,800 | 2 | 7,700 |
| | Nil | 0.75 | 0.02 | 1,700 | 6,500 | 0 | 7,500 |
| 12 | 10 | 0.57 | 0.01 | 1.850 | 8,700 | 1 | 7,650 |

What is claimed is:

1. A process for improving the antistatic and hygroscopic properties of polyamide fibers or fibrous structures made thereof, which comprises heating polyamide fiber or fibrous structure made thereof at a temperature of from 95° to 130° C. while in contact with an aqueous treating solution consisting essentially of from 0.02 to 10% by weight of at least one water-soluble vinyl monomer selected from the group consisting of N,N'-methylene-bis-acrylamide and triacryloyl hexahydrotriazine, from 0.05 to 3.0% by weight of at least one acid selected from the group consisting of formic acid, monochloroacetic acid, dichloroacetic acid, trichloroacetic acid, sulfuric acid, hydrochloric acid, nitric acid, phosphoric acid, acetic acid, tartaric acid and oxalic acid, and the balance is essentially water, said treating solution being free of polymerization initiator, whereby to graft polymerize said vinyl monomer with said polyamide.

2. A process as claimed in claim 1 in which, in said heating step, said polyamide fiber or fibrous structure made thereof is soaked in a bath of said treating solution at said temperature.

3. A process as claimed in claim 1 in which said polyamide fiber or fibrous structure made thereof is padded with said treating solution and then is steamed at said temperature.

4. A process as claimed in claim 1 in which said vinyl monomer consists of N,N'-methylene-bis-acrylamide.

5. A process as claimed in claim 4 in which said acid is formic acid.

6. A process as claimed in claim 1, wherein the amount of the water-soluble vinyl monomer is 0.03 to 5% by weight based on the weight of the treating solution.

7. A process as claimed in claim 1, wherein the amount of the acid is 0.1 to 1.0% by weight based on the weight of the treating solution.

8. A process as claimed in claim 1, wherein the heating is conducted for 40 minutes to 5 hours.

9. A process as claimed in claim 1, wherein the heating is conducted for 1 to 3 hours.

10. A process as claimed in claim 2, wherein the heating is conducted at bath ratio of not exceeding 1/15, wherein bath ratio is the weight ratio of said fiber or fibrous structure/said treating solution.

11. A process as claimed in claim 10, wherein the bath ratio ranges from 1/20 to 1/200.

12. A process as claimed in claim 3, wherein the fiber or fibrous structure is padded and squeezed so that the amount of treating solution picked up is from 20 to 200% by weight, based on the weight of the fiber or fibrous structure.

13. A process as claimed in claim 1, which further comprises a step of washing the fiber or fibrous article with water after the heating.

14. A product manufactured according to a process as claimed in claims 1.

* * * * *